US007764249B2

(12) United States Patent
Kim et al.

(10) Patent No.: US 7,764,249 B2
(45) **Date of Patent: *Jul. 27, 2010**

(54) METHOD AND APPARATUS FOR DRIVING PLASMA DISPLAY PANEL

(75) Inventors: Young Dae Kim, Busan-kwangyeokshi (KR); Sang Jin Yun, Kyoungsangbuk-do (KR); Yong Tae Jeon, Kyoungsan-shi (KR)

(73) Assignee: LG Electronics Inc., Seoul (KR)

( * ) Notice: Subject to any disclaimer, the term of this patent is extended or adjusted under 35 U.S.C. 154(b) by 798 days.

This patent is subject to a terminal disclaimer.

(21) Appl. No.: 11/318,514

(22) Filed: Dec. 28, 2005

(65) Prior Publication Data

US 2006/0103596 A1 May 18, 2006

Related U.S. Application Data

(63) Continuation of application No. 10/757,475, filed on Jan. 15, 2004, now Pat. No. 7,109,951.

(30) Foreign Application Priority Data

Jan. 16, 2003 (KR) ..... 10-2003-0002856

(51) Int. Cl.
*G09G 3/28* (2006.01)

(52) U.S. Cl. ..... 345/60; 315/169.4; 313/581; 345/67

(58) Field of Classification Search ..... 345/60–72; 315/169.4; 313/581–587
See application file for complete search history.

(56) References Cited

U.S. PATENT DOCUMENTS 6,034,482 A 3/2000 Kanazawa et al. ..... 315/169.4
6,249,087 B1 6/2001 Takayama et al.
6,256,001 B1 7/2001 Kim et al. ..... 345/60
6,288,692 B1 9/2001 Kanazawa et al. ..... 345/67
6,294,875 B1 9/2001 Kurata et al. ..... 316/169.1
6,528,952 B2 3/2003 Kato et al. ..... 315/169.4
6,603,447 B1 8/2003 Ito et al. ..... 345/60
6,628,087 B2 * 9/2003 Roh et al. ..... 315/169.3
6,707,436 B2 3/2004 Setoguchi et al. ..... 345/60
6,747,614 B2 6/2004 Takayama (Continued)

FOREIGN PATENT DOCUMENTS

CN 1313582 9/2001

(Continued)

OTHER PUBLICATIONS

International Search Report dated Nov. 1, 2004 for PCT/KR2004/001865.

*Primary Examiner*—Jimmy H Nguyen
(74) *Attorney, Agent, or Firm*—KED & Associates, LLP

(57) ABSTRACT

A method and apparatus for driving a plasma display panel for preventing and a spot misfire and a miswriting is disclosed. In the method, wall charges are formed at a discharge cell in an initial period. The discharge cell selects discharge cells in an address period. A wall charge control period is arranged between said initialization period and said address period. A wall charge distribution at the discharge cell is controlled in the wall charge control period. A sustain discharge is caused at discharge cells selected in said address period in the sustain period.

24 Claims, 8 Drawing Sheets

U.S. PATENT DOCUMENTS

| | | | | |
|---|---|---|---|---|
| 6,803,888 | B1 | 10/2004 | Nakamura et al. | 345/60 |
| 6,862,009 | B2 | 3/2005 | Park | 345/67 |
| 6,876,343 | B2 | 4/2005 | Myoung et al. | 345/67 |
| 6,906,690 | B2 | 6/2005 | Lim | 345/60 |
| 7,109,951 | B2 * | 9/2006 | Kim et al. | 345/63 |
| 7,218,292 | B2 * | 5/2007 | Kashio et al. | 345/60 |
| 2001/0033255 | A1 * | 10/2001 | Otsuka et al. | 345/60 |
| 2002/0063663 | A1 | 5/2002 | Homma | |
| 2002/0075206 | A1 | 6/2002 | Takeda et al. | |

FOREIGN PATENT DOCUMENTS

| | | | |
|---|---|---|---|
| EP | 1 172 794 | A2 | 1/2002 |
| JP | 11-265164 | | 9/1999 |
| JP | 2001-202060 | | 7/2001 |
| JP | 2001-272946 | | 10/2001 |
| JP | 2002-351398 | | 12/2002 |

* cited by examiner

Set-down

METHOD AND APPARATUS FOR DRIVING PLASMA DISPLAY PANEL

CROSS-REFERENCE TO RELATED APPLICATIONS

This is a Continuation Application of prior application Ser. No. 10/757,475 filed Jan. 15, 2004 now U.S. Pat. No. 7,109,951 whose entire disclosure is incorporated herein by reference. Further, this application claims the benefit of the Korean Application No. P2003-2856 filed on Jan. 16, 2003, which is hereby incorporated by reference.

BACKGROUND OF THE INVENTION

1. Field of the Invention

This invention relates to a plasma display panel, and more particularly to a method and apparatus for driving a plasma display panel that is adaptive for preventing a spot misfire and a miswriting.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a scan electrode 30Y and a sustain electrode 30Z provided on an upper substrate 10, and an address electrode 20X provided on a lower substrate 18. Each of the scan electrode 30Y and the sustain electrode 30Z includes transparent electrodes 12Y and 12Z, and metal bus electrodes 13Y and 13Z having smaller line widths than the transparent electrodes 12Y and 12Z and provided at one edge of the transparent electrodes 12Y and 12Z.

The transparent electrodes 12Y and 12Z are usually formed from indium-tin-oxide (ITO) on the upper substrate 10. The metal bus electrodes 13Y and 13Z are usually formed from a metal such as chrome (Cr), etc. on the transparent electrodes 12Y and 12Z to thereby reduce a voltage drop caused by the transparent electrodes 12Y and 12Z having a high resistance.

On the upper substrate 10 provided, in parallel, with the scan electrode 30Y and the common sustain electrode 30Z, an upper dielectric layer 14 and a protective film 16 are disposed. Wall charges generated upon plasma discharge are accumulated onto the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material 26. The address electrode 20X is formed in a direction crossing the scan electrode 30Y and the sustain electrode 30Z. The barrier rib 24 is formed in parallel to the address electrode 20X to thereby prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive mixture gas for a gas discharge is injected into a discharge space defined between the upper and lower substrate 10 and 18 and the barrier rib 24.

Such a PDP makes a time-divisional driving of one frame, which is divided into various sub-fields having a different emission frequency, so as to realize gray levels of a picture. Each sub-field is again divided into an initialization period for initializing the entire field, an address period for selecting a scan line and selecting the cell from the selected scan line and a sustain period for expressing gray levels depending on the discharge frequency. Herein, the initialization period is again divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of 2n (wherein n=0, 1, 2, 3, 4, 5, 6 and 7) at each sub-field.

FIG. 3 shows a driving waveform of the PDP applied to two sub-fields. In FIG. 3, Y represents the scan electrode; Z denotes the sustain electrode; and X denotes the address electrode.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied to the entire scan electrodes Y in a set-up interval. This rising ramp waveform Ramp-up causes a weak discharge within cells at the full field to generate wall charges within the cells. The rising ramp waveform Ramp-up rises from a sustain voltage Vs until a sum value of a set-up voltage Vsetup with the sustain voltage Vs.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage Vs until a negative voltage −Vy so that desired wall charges can be left during the set-down interval.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge.

Meanwhile, a positive direct current voltage having a sustain voltage level Vs is applied to the sustain electrodes Z during the set-down interval and the address period.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrode Y and the common sustain electrode Z whenever each sustain pulse sus is applied. Finally, after the sustain discharge was finished, a erasing ramp waveform erase having a small pulse width is applied to the sustain electrode Z to thereby erase wall charges left within the cells.

In the set-up interval of such a convention PDP, the scan electrode Y is supplied with a positive voltage while the sustain electrode Z is supplied with a negative voltage (or a ground voltage). Accordingly, in the set-up interval, negative wall charges are formed at the scan electrode Y while positive wall charges are formed at the sustain electrode Z as shown in FIG. 4. The falling ramp waveform Ramp-down falling from a positive voltage lower than a peak voltage of the rising ramp waveform Ramp-up are supplied in the set-down interval. Thus, spurious wall charges formed excessively and non-uniformly are erased to thereby reduce the wall charges within the cell into a predetermined amount.

Subsequently, in the address period, the scan electrode Y is supplied with a negative voltage while the sustain electrode Z is supplied with a positive voltage. At this time, a voltage value (having a negative polarity) of wall charges formed in the set-down interval is added to a negative voltage value applied to the scan electrode Y, to thereby cause an address discharge.

The conventional PDP driven as mentioned above does not make a stable address discharge until desired wall charges are formed in the initialization period. However, in the conventional PDP, desired wall charges are not formed in the initialization period depending upon a property of the panel, and thus a spot misfire or a miswriting occurs.

More specifically, when wall charges are normally formed in the initialization period, negative wall charges are formed at the scan electrode Y while positive wall charges are formed at the sustain electrode Z as shown in FIG. 4. However, due to problems of the panel property, etc., positive wall charges are formed at the scan electrode Y of a portion of discharge cells during the set-down interval as shown in FIG. 5. In other words, the falling ramp waveform Ramp-down falls until a negative voltage −Vy in the set-down interval. At this time, positive wall charges are formed at the scan electrode Y provided at the portion of discharge cells. If positive wall charges are formed at the scan electrode Y as mentioned above, then a spot misfire or a miswriting is generated to thereby cause a deterioration of picture quality in the PDP.

SUMMARY OF THE INVENTION

Accordingly, it is an object of the present invention to provide a method and apparatus for driving a plasma display panel that is adaptive for preventing a spot misfire and a miswriting.

In order to achieve these and other objects of the invention, a method of driving a plasma display panel according to one aspect of the present invention includes an initial period for forming wall charges at a discharge cell; an address period for selecting the discharge cell; a wall charge control period, being arranged between said initialization period and said address period, for controlling a wall charge distribution at the discharge cell; and a sustain period for causing a sustain discharge at discharge cells selected in said address period.

In the method, said initialization period is divided into a set-up interval and a set-down interval; a rising ramp waveform rising at a first slope from a sustain voltage until a sum value of said sustain voltage and a set-up voltage; and a falling ramp waveform falling at a second slope from said sustain voltage until a negative voltage.

A control pulse having a voltage rising at said first slope from a ground voltage is applied to the scan electrode during said wall charge control period.

Herein, a voltage of said control pulse is a voltage less than said set-up voltage.

An application time of said control pulse is differentiated depending upon sub-fields.

Herein, an application time of said control pulse is set more shortly as it goes from a sub-field arranged in an initial time of a frame into the last sub-field of the frame.

Alternatively, an application time of said control pulse is set longer as it goes from a sub-field arranged in an initial time of a frame into the last sub-field of the frame.

Application time of said control pulse is equal to each other at the entire sub-fields included in one frame.

A ground voltage is applied to a sustain electrode arranged in parallel to the scan electrode during said wall charge control period.

A control pulse rising at a slope different from said first slope from a ground voltage is applied to the scan electrode during wall charge control period.

Alternatively, a rectangular control pulse having said sustain voltage is applied to the scan electrode during said wall charge control period.

Herein, said control pulse is applied during a time less than 1 μs.

An application time of said control pulse is differentiated depending upon sub-fields.

Application time of said control pulse is equal to each other at the entire sub-fields included in one frame.

A ground voltage is applied to a sustain electrode arranged in parallel to the scan electrode during said wall charge control period.

A driving apparatus for a plasma display panel according to another aspect of the present invention includes a set-up supplier for supplying a rising ramp waveform to scan electrodes during an initialization period; and a scan voltage supplier for sequentially supplying a scanning pulse to the scan electrodes during an address period, wherein the set-up supplier applies a control pulse rising at the same slope as said rising ramp waveform to the scan electrodes between said initialization period and said address period.

Herein, after said control pulse was supplied, a ground voltage is applied to the scan electrodes.

A driving apparatus for a plasma display panel according to still another aspect of the present invention includes a set-up supplier for supplying a rising ramp waveform to scan electrodes during an initialization period; a scan voltage supplier for sequentially supplying a scanning pulse to the scan electrodes during an address period; an energy recovering circuit for supplying a sustaining pulse having a sustain voltage during a sustain period; and a scan reference voltage supplier for supplying a scan reference voltage to the remaining scan electrodes other than said scan electrodes to which said scanning pulse is applied during said address period, wherein said energy recovering circuit applies a rectangular control pulse having said sustain voltage to the scan electrodes between said initialization period and said address period.

In the driving apparatus, prior to said control pulse was supplied, said scan reference voltage is applied to the scan electrodes.

Said control pulse is applied during a time less than 1 μs.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
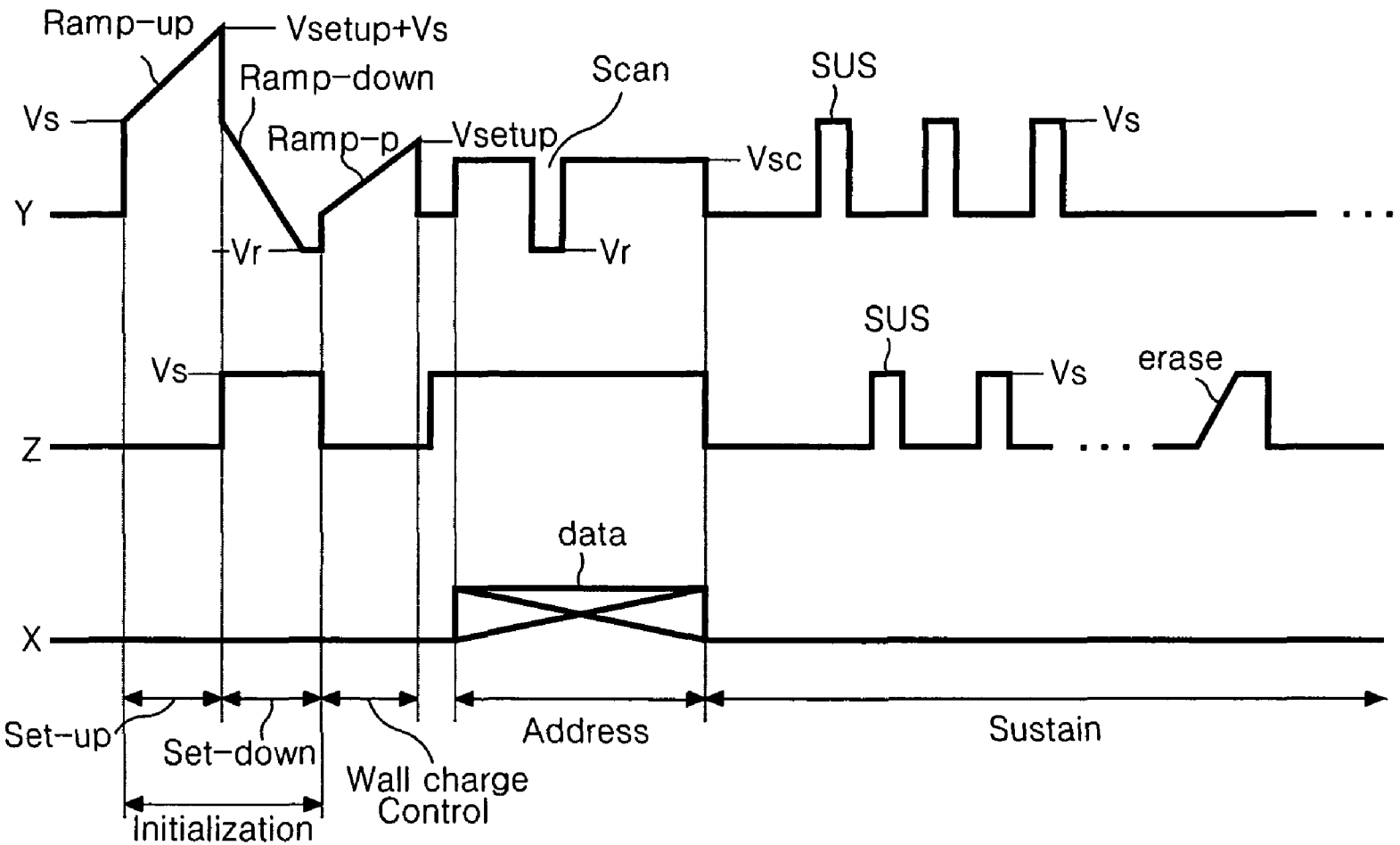
FIG. 6 is a waveform diagram for explaining a method of driving a plasma display panel according to a first embodiment of the present invention.

FIG. 6 shows a method of driving a plasma display panel (PDP) according to a first embodiment of the present invention.

Referring to FIG. 6, the PDP according to the first embodiment of the present invention is divided into an initialization period for initializing the entire field, a wall charge control period for preventing an inversion of wall charges, an address period for selecting a cell and a sustain period for sustaining a discharge of the selected cell for its driving.

In the initialization period, a rising ramp waveform Ramp-up is simultaneously applied to all of scan electrodes Y in a set-up interval. This rising ramp waveform Ramp-up causes a weak discharge within cells at the full field to generate wall charges within the cells. The rising ramp waveform Ramp-up rises from a sustain voltage Vs until a sum value of a set-up voltage Vsetup with the sustain voltage Vs.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage Vs until a negative voltage −Vy so that desired wall charges can be left during the set-down interval.

In the wall charge control period, the scan electrodes Y are supplied with a positive control pulse Ramp-p rising from a ground voltage GND until a set-up voltage Vsetup. If the positive control pulse Ramp-p is applied to the scan electrodes Y, then a fine discharge is generated at the discharge cells to thereby control the polarities of the discharge cells into desired types.

Figure 1:
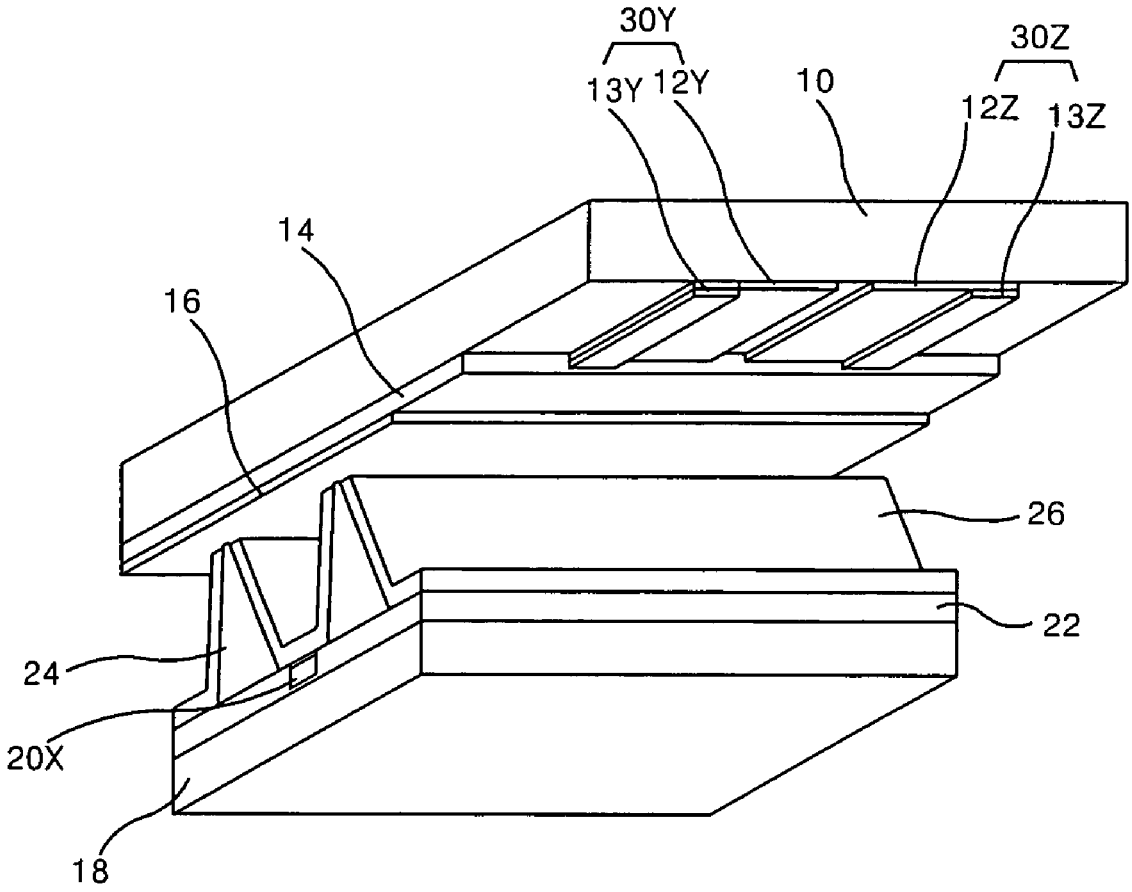
FIG. 1 RELATED ART
FIG. 1 is a perspective view showing a discharge cell structure of a conventional three-electrode, AC surface-discharge plasma display panel.
Figure 2:
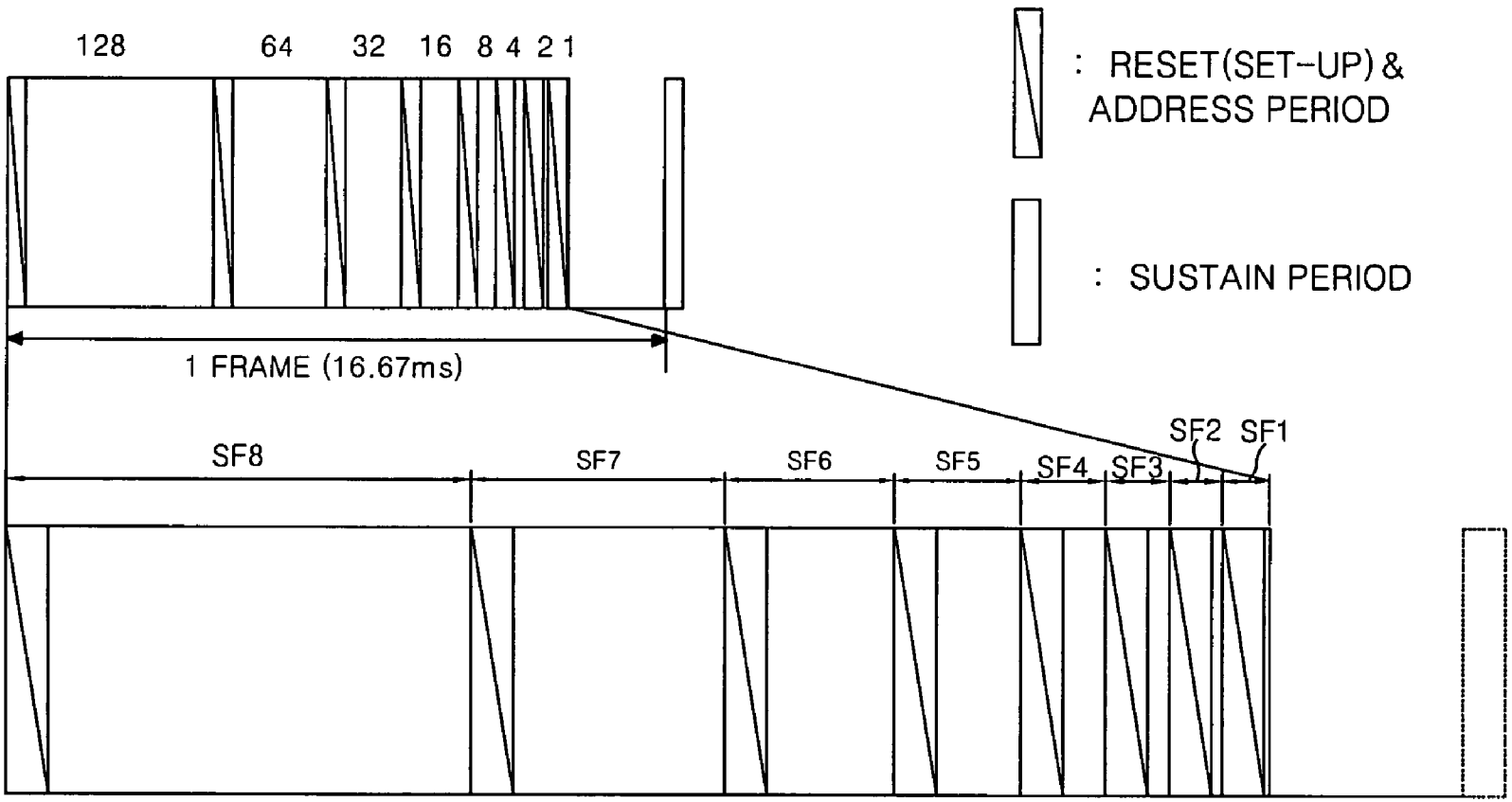
FIG.2 RELATED ART
FIG. 2 illustrates sub-fields included in one frame of the conventional plasma display panel.
Figure 3:
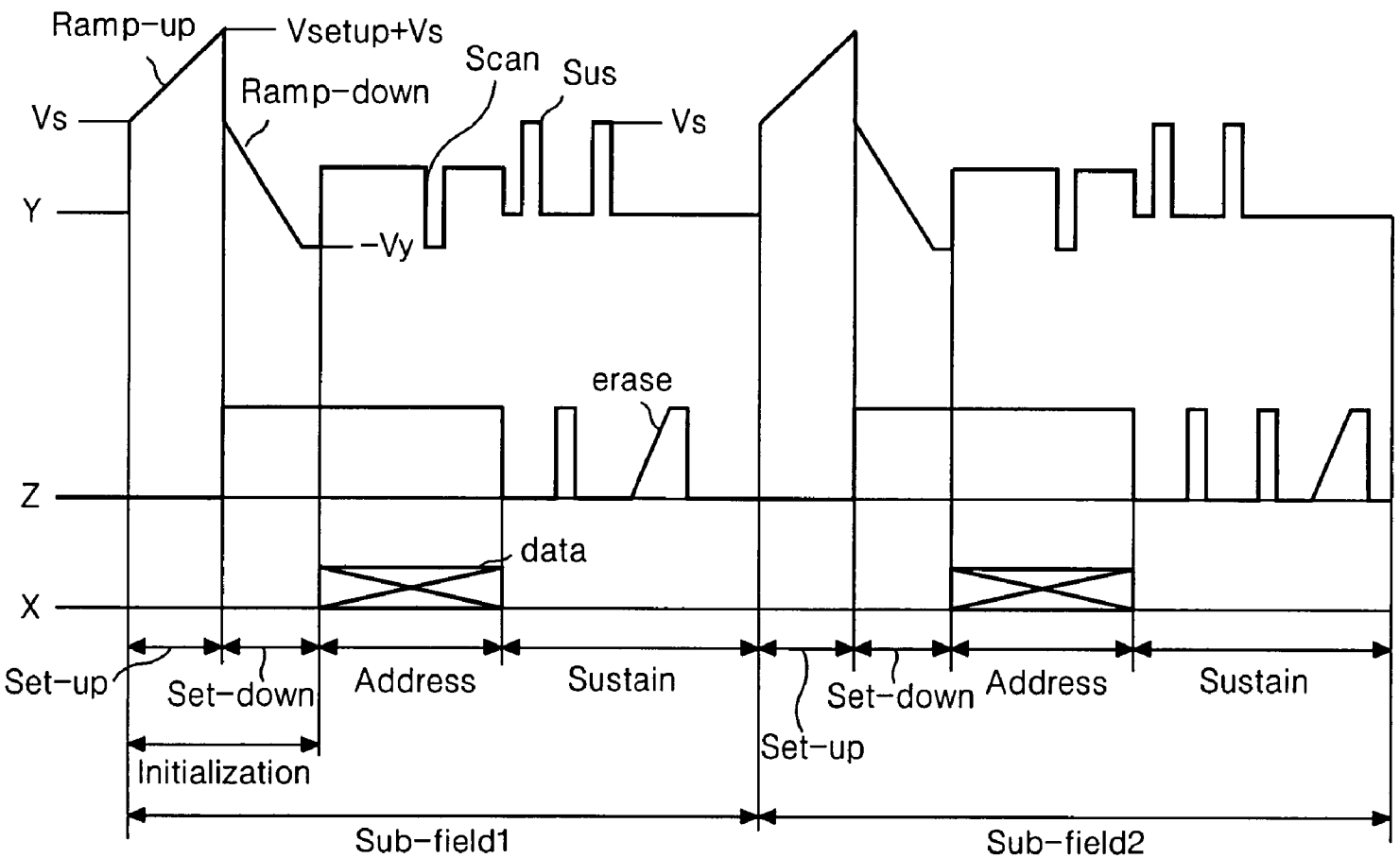
FIG. 3 RELATED ART
FIG. 3 is a waveform diagram of driving signals supplied to the electrodes during the sub-fields shown in FIG. 2.
Figure 4:
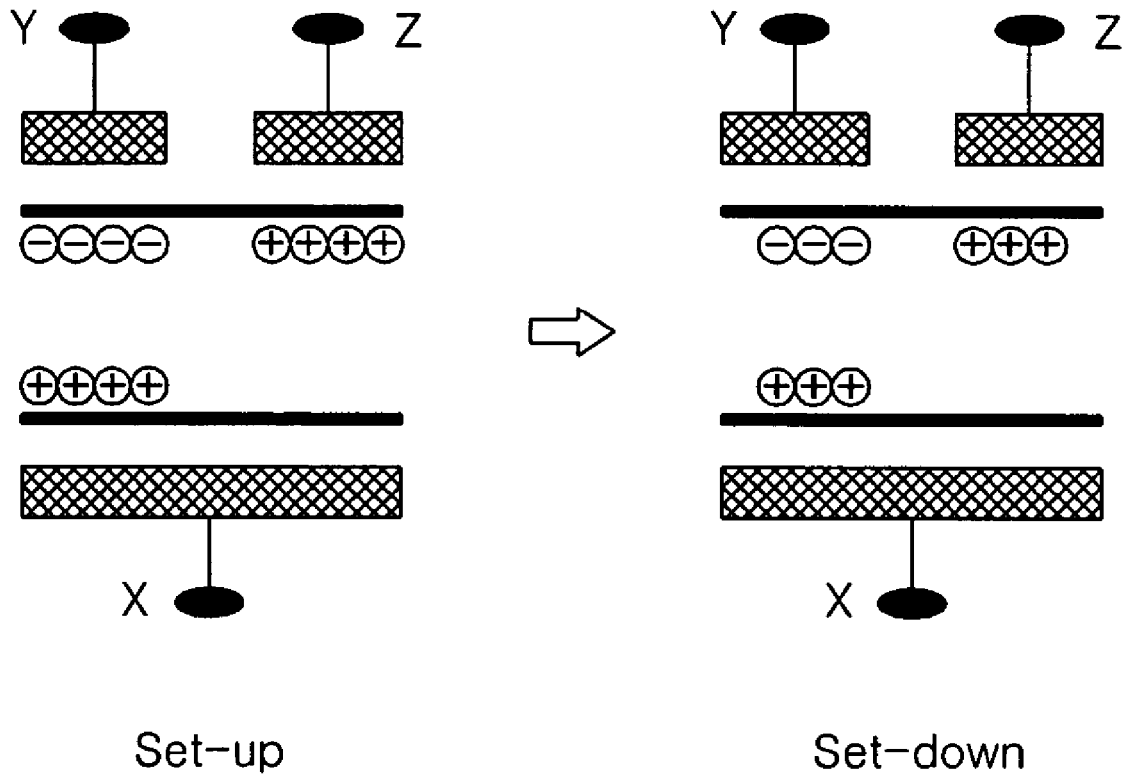
FIG. 4 RELATED ART
FIG. 4 depicts wall charges formed at the electrodes in the initialization period shown in FIG. 2.
Figure 5:
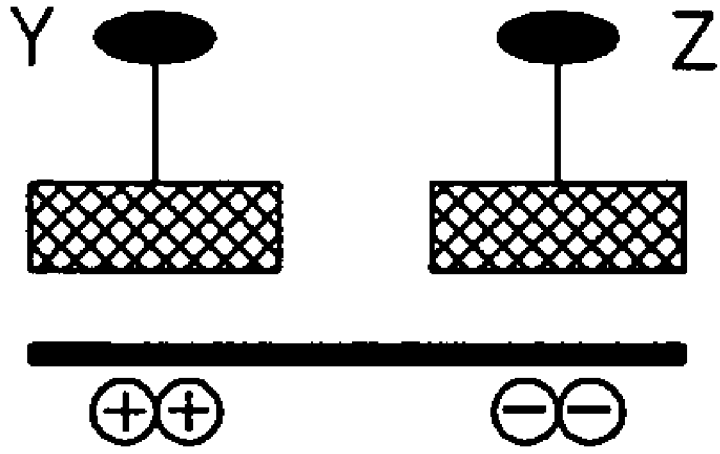
FIG. 5 RELATED ART
FIG. 5 depicts wall charges formed at a portion of discharge cells in the initialization period shown in FIG. 2.

More specifically, in the set-down interval, wall charges having an undesired type of polarities are formed at a portion of discharge cells as shown in FIG. 5. Thereafter, if the positive control pulse Ramp-p is applied to the scan electrodes Y, then a fine discharge is generated at the discharge cells to thereby form negative wall charges at the scan electrodes Y while forming positive wall charges at the sustain electrodes Z. In other words, in the embodiment of the present invention, the polarities of wall charges of the entire discharge cells can be controlled into desired polarities during the wall charge control period.

Meanwhile, an application time of the control pulse Ramp-p can be set in various methods. For instance, an application time of the control pulse Ramp-p may be set equally or differently for each sub-field. Herein, if an application time of the control pulse Ramp-p is set differently for each sub-field, then a voltage value of the control pulse Ramp-p also is set differently for each sub-field. In other words, an application time of the control pulse Ramp-p rising at the same slope is controlled, so that the control pulse Ramp-p having a different voltage value can be applied to each sub-field. Herein, an application time of the control pulse may be set to be shorter as it goes from the initial sub-field into the later sub-fields. Then, as it goes from the initial sub-field into the later sub-fields, a voltage value of the control pulse becomes lower. Alternatively, an application of the control pulse may be set to be longer as it goes from the initial sub-field into the later sub-fields. In real, an application time of the control pulse is experimentally determined in consideration of a length (i.e., inch) of the panel, a resolution of the panel and a process state, etc. Otherwise, the control pulse Ramp-p having different slope and/or voltage for each sub-field may be supplied.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge. In the above-mentioned embodiment of the present invention, negative wall charges are formed at the scan electrodes of the entire discharge cells during the wall charge control period to thereby cause a stable address discharge. Accordingly, it becomes possible to prevent a miswriting and/or a spot misfire.

Meanwhile, a positive direct current voltage having a sustain voltage level Vs is applied to the sustain electrodes Z during the set-down interval and the address period. Further, in the wall charge control period, the sustain electrodes Z are supplied with a ground voltage GND. The sustain electrodes Z are supplied with the ground voltage GND during the wall charge control period to thereby cause a stable intensified discharge.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrode Y and the common sustain electrode Z whenever each sustain pulse sus is applied. Finally, after the sustain discharge was finished, an erasing ramp waveform erase having a small pulse width is applied to the sustain electrode Z to thereby erase wall charges left within the cells.

Figure 7:
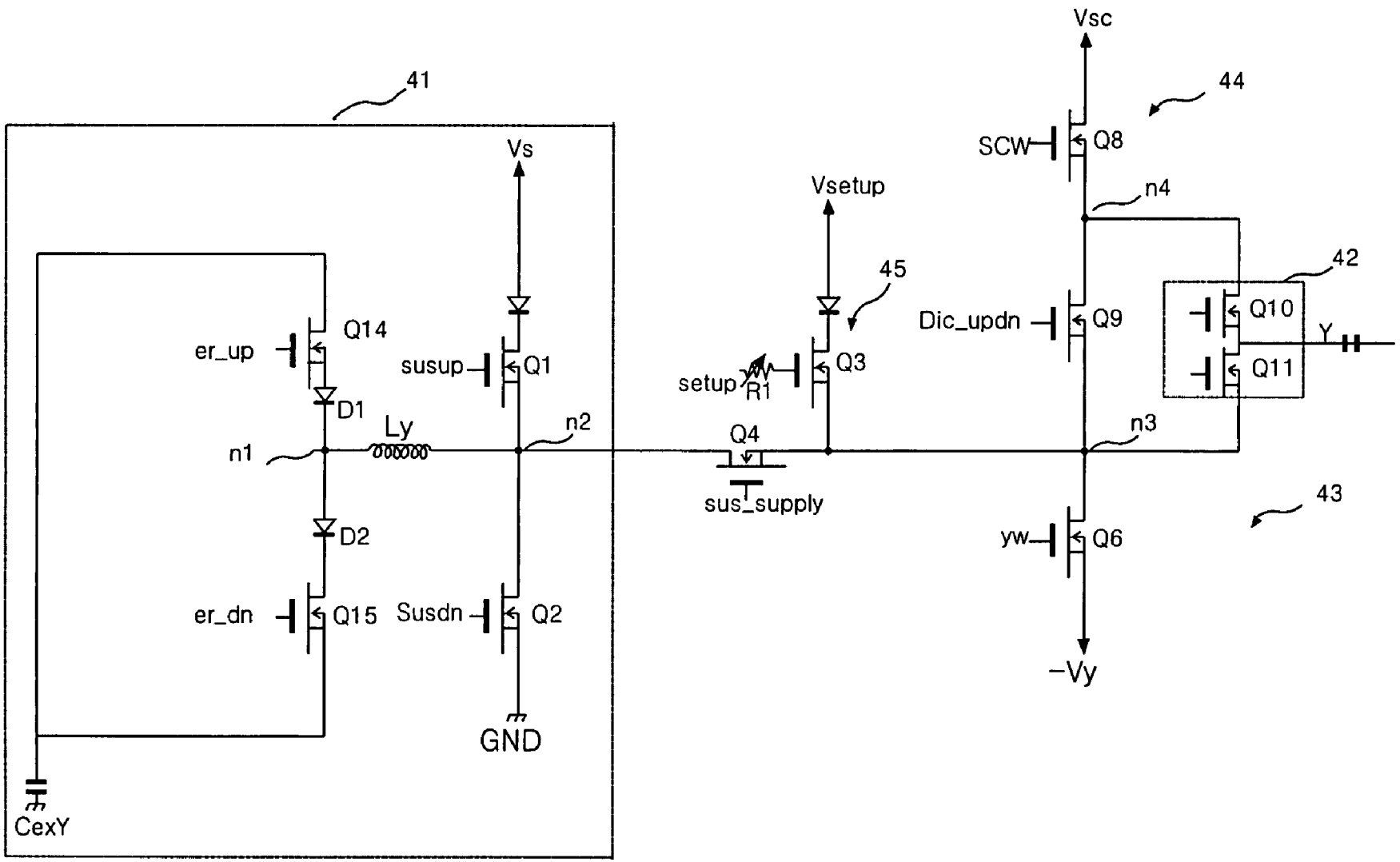
FIG. 7 is a circuit diagram of a driving apparatus for the plasma display panel according to an embodiment of the present invention.

FIG. 7 shows a scan electrode driver according to an embodiment of the present invention.

Referring to FIG. 7, the scan electrode driver includes an energy recovering circuit 41, a fourth switch Q4 connected between the energy recovering circuit 41 and a driving integrated circuit (IC) 42, a negative scan voltage supplier 43 and a scan reference voltage supplier 44 connected between the fourth switch Q4 and the driving IC 42 to apply a scanning pulse Scan, and a set-up supplier 45 connected among the fourth switch Q4, the negative scan voltage supplier 43 and the scan reference voltage supplier 44 to generate a rising ramp waveform Ramp-up.

The driving IC 42 is connected in a push-pull shape, and consists of tenth and eleventh switches Q10 and Q11 to which voltage signals from the energy recovering circuit 41, the scan voltage supplier 43 and the scan reference voltage supplier 44 are inputted. An output line between the tenth and eleventh switches Q10 and Q11 are connected to any one of scan electrode lines Y1 to Ym.

The energy recovering circuit 41 includes an external capacitor CexY for charging an energy recovered from the scan electrode lines Y1 to Ym, switches Q14 and Q15 connected, in parallel, to the external capacitor CexY, an inductor Ly connected between a first node n1 and a second node n2, a first switch Q1 connected between a sustain voltage supply Vs and the second node n2, and a second switch Q2 connected between the second node n2 and a ground voltage terminal GND.

An operation of the energy recovering circuit 41 will be described below.

First, it is assumed that a Vs/2 voltage has been charged in the external capacitor CexY. If the fourteenth switch Q14 is turned on, then a voltage charged in the external capacitor CexY is applied, via the fourth switch Q14, a first diode D1, the inductor Ly and the fourth switch Q4, to the driving IC 42 and, at the same time, is applied, via an internal diode (not shown), to the scan electrode lines Y1 to Ym. At this time, the inductor Ly configures a serial LC resonance circuit along with a capacitance C of the cell of the PDP to thereby apply a resonating waveform to the scan electrode lines Y1 to Ym.

The first switch Q1 is turned on at a resonance point of the resonating waveform. If the first switch Q1 is turned on, then the sustain voltage Vs is applied, via the first switch Q1 and the driving IC 42, to the scan electrode lines Y1 to Ym. During the time interval when voltages on the scan electrode lines Y1 to Ym are charged and discharged by such an operation of the energy recovering circuit 41, the fourth switch Q4 keeps an ON state so as to form a current path between the energy recovering circuit 41 and the driving IC 42.

The energy recovering circuit 41 recovers an energy from the PDP and then applies a voltage to the scan electrode lines Y1 to Ym using the recovered energy, thereby reducing an excessive power consumption upon discharging in the set-up interval and in the sustain period.

The negative scan voltage supplier 43 consists of a sixth switch Q6 connected between a third node n3 and a scan voltage source −Vy. The sixth switches Q6 is switched in response to a control signal yw from a timing controller (not shown) during the address period to thereby apply a scan voltage −Vy to the driving IC n4.

The scan reference voltage supplier 44 consists of an eighth switch Q8 connected between a scan reference voltage source Vsc and a fourth node n4. The eighth switch Q8 is switched in response to a control signal SCW from the timing controller (not shown) to thereby apply the scan reference voltage Vsc to the driving IC 42.

The set-up supplier 45 consists of a fourth diode D4 and a third switch Q3 connected between a set-up voltage source Vsetup and a third node n3. The fourth diode D4 shuts off a backward current flowing from the third node n3 into the set-up voltage source Vsetup. The third switch Q3 is switched in response to a control signal setup from the timing controller (not shown) to thereby apply a rising ramp waveform Ramp-up having a slope determined by a RC time constant value to the third node n3.

A procedure in which a control pulse Ramp-p is supplied from the scan electrode driver of the present invention will be described below.

First, since a control signal set-up is applied via a first variable resistor R1, a channel width of the third switch Q3 is controlled by a resistance value of the first variable resistor R1. In real, a channel width of the third switch Q3 is controlled by a capacitance value of a capacitor or a parasitic capacitor (not shown) and a RC time constant of the first variable resistor R1.

Accordingly, a control pulse Ramp-p supplied via the third switch Q3 at a predetermined slope (i.e., the same slope as the rising ramp waveform) is applied, via the third node n3, to the driving IC 42. The control pulse Ramp-p applied to the driving IC 42 is applied, via the driving IC 42, to the scan electrode Y. If the control pulse Ramp-p is applied to the scan electrode Y, then an intensified discharge is generated at the discharge cells to thereby form negative wall charges at the entire scan electrodes Y. After the control pulse Ramp-p was applied to the scan electrodes Y, the second switch Q2 is turned on. If the second switch Q2 is turned on, then a ground voltage GND is applied to the scan electrodes Y.

Such an embodiment of the present invention can apply the control pulse Ramp-p with the aid of the set-up supplier 45 for supplying the rising ramp waveform without any additional circuit for supplying the control pulse Ramp-p.

Figure 8:
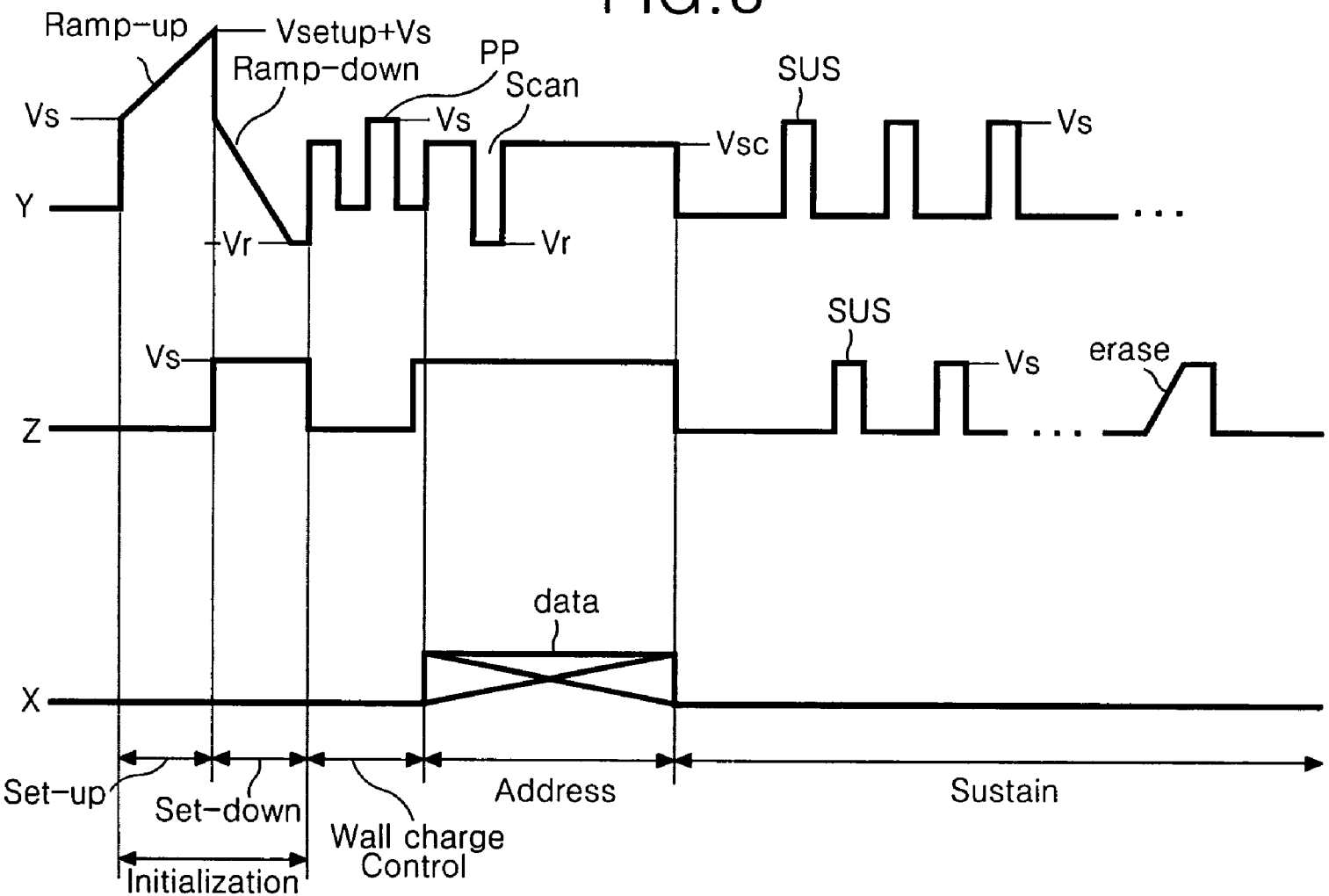
FIG. 8 is a waveform diagram for explaining a method of driving a plasma display panel according to a first embodiment of the present invention.

FIG. 8 shows a method of driving a plasma display panel (PDP) according to a second embodiment of the present invention.

Referring to FIG. 8, the PDP according to the second embodiment of the present invention is divided into an initialization period for initializing the entire field, a wall charge control period for preventing an inversion of wall charges, an address period for selecting a cell and a sustain period for sustaining a discharge of the selected cell for its driving.

In the initialization period, a rising ramp waveform Ramp-up is simultaneously applied to all of scan electrodes Y in a set-up interval. This rising ramp waveform Ramp-up causes a weak discharge within cells at the full field to generate wall charges within the cells. The rising ramp waveform Ramp-up rises from a sustain voltage Vs until a sum value of a set-up voltage Vsetup with the sustain voltage Vs.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage Vs until a negative voltage −Vy so that desired wall charges can be left during the set-down interval.

In the wall charge control period, the scan electrodes Y are supplied with a rectangular control pulse pp rising from a ground voltage GND until a sustain voltage Vs. If the rectangular control pulse pp is applied to the scan electrodes Y, then a discharge is generated at the discharge cells to thereby control the polarities of the discharge cells into desired types.

More specifically, in the set-down interval, wall charges having an undesired type of polarities are formed at a portion of discharge cells as shown in FIG. 5. Thereafter, if the rectangular control pulse pp is applied to the scan electrodes Y, then a discharge is generated at the discharge cells to thereby form negative wall charges at the scan electrodes Y while forming positive wall charges at the sustain electrodes Z. In other words, in the embodiment of the present invention, the polarities of wall charges of the entire discharge cells can be controlled into desired polarities during the wall charge control period.

Meanwhile, an application time of the control pulse pp is set within 1 μs. For instance, an application time of the control pulse pp may be set more shortly as it goes from the initial sub-field into the later sub-fields. Alternatively, an application time of the control pulse pp may be set longer as it goes from the initial sub-field into the later sub-fields. In real, an application time of the control pulse pp is experimentally determined in consideration of a length (i.e., inch) of the panel, a resolution of the panel and a process state, etc. Further, a scan reference voltage Vsc is applied to the scan electrode Y prior to an application of the control pulse pp. FIG. 8 shows a pulse having the scan reference voltage Vsc applied in the wall charge control period prior to the control pulse pp.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge. In the above-mentioned embodiment of the present invention, negative wall charges are formed at the scan electrodes Y of the entire discharge cells during the wall charge control period to thereby cause a stable address discharge. Accordingly, it becomes possible to prevent a miswriting and/or a spot misfire.

Meanwhile, a positive direct current voltage having a sustain voltage level Vs is applied to the sustain electrodes Z during the set-down interval and the address period. Further, in the wall charge control period, the sustain electrodes Z are supplied with a ground voltage GND. The sustain electrodes Z are supplied with the ground voltage GND during the wall charge control period to thereby cause a stable intensified discharge.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrode Y and the common sustain electrode Z whenever each sustain pulse sus is applied. Finally, after the sustain discharge was finished, an erasing ramp waveform erase having a small pulse width is applied to the sustain electrode Z to thereby erase wall charges left within the cells.

In the mean time, in FIG. 8, the control pulse pp can be supplied by means of the scan electrode driver shown in FIG. 7. This will be described with reference to FIG. 7 below.

First, an eighth switch Q8 is turned on during the wall charge control period to thereby apply a scan reference voltage Vsc to the scan electrodes Y. Thereafter, a second switch Q2 is turned on, to thereby apply a ground voltage GND to the scan electrodes Y. After the ground voltage GND was applied to the scan electrodes Y, a first switch Q1 is switched (e.g., during a time less than 1 μs), to thereby apply a control pulse pp having a sustain voltage level Vs to the scan electrodes Y. Thereafter, the ground voltage GND, the scan reference voltage Vs and a scan voltage −Vr are applied to the scan electrodes Y, to thereby cause an address discharge.

As described above, according to the present invention, a control pulse is applied after the reset period to thereby prevent an inversion phenomenon of wall charges. In other words, a positive control pulse is applied to the scan electrodes after the reset period to thereby form negative wall charges at the entire scan electrodes. Accordingly, it becomes possible to generate a stable address discharge and thus to prevent a miswriting and a spot misfire.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, comprising:

providing an initialization period for forming wall charges at a discharge cell;

providing an address period for selecting the discharge cell;

providing a wall charge control period, arranged between said initialization period and said address period, the wall charge control period for applying a control pulse to a scan electrode for controlling a wall charge distribution at the discharge cell, wherein the control pulse has a positive peak voltage value; and providing a sustain period for causing a sustain discharge at discharge cells selected in said address period, wherein providing the wall charge control period includes applying another pulse to the scan electrode, and wherein a peak voltage value of the another pulse is less than the positive peak voltage value of the control pulse.

2. The method as claimed in claim 1, wherein said initialization period is divided into a set-up interval and a set-down interval, and providing the initialization period includes providing a rising waveform that increases at a first slope from a sustain voltage until a sum value of said sustain voltage and a set-up voltage and providing a falling waveform that decreases at a second slope from said sustain voltage to a negative voltage.

3. The method as claimed in claim 2, wherein said positive peak voltage value of the control pulse is less than a peak voltage of said rising waveform.

4. The method as claimed in claim 1, wherein an application time of said control pulse is differentiated depending upon sub-fields.

5. The method as claimed in claim 4, wherein an application time of said control pulse in a sub-field arranged in an initial time of a frame is greater than an application time of said control pulse in a last sub-field of the frame.

6. The method as claimed in claim 4, wherein an application time of said control pulse in a sub-field arranged in an initial time of a frame is less than an application time of said control pulse in a last sub-field of the frame.

7. The method as claimed in claim 1, wherein an application time of said control pulse is substantially the same for each of a plurality of sub-fields included in one frame.

8. The method as claimed in claim 1, wherein during the wall charge control period a ground voltage is applied to a sustain electrode arranged in parallel to the scan electrode.

9. The method as claimed in claim 1, wherein the control pulse is a rectangular control pulse having a sustain voltage that is applied to the scan electrode.

10. The method as claimed in claim 9, wherein said control pulse is applied to the scan electrode for less than 1 μs.

11. The method as claimed in claim 10, wherein an application time of said control pulse is differentiated depending upon sub-fields.

12. The method as claimed in claim 10, wherein an application time of said control pulse is substantially the same for each of a plurality of sub-fields included in one frame.

13. The method as claimed in claim 9, wherein during the wall charge control period a ground voltage is applied to a sustain electrode arranged in parallel to the scan electrode.

14. The method as claimed in claim 1, wherein the plasma display panel includes the scan electrode, a data electrode and a plurality of common sustain electrodes.

15. A plasma display apparatus comprising:

a scan electrode and a plurality of common sustain electrodes formed on a first substrate;

an address electrode formed on a second substrate;

a plurality of barrier ribs provided between the first substrate and the second substrate;

a cell defined by the scan, sustain and address electrodes, and the plurality of barrier ribs, wherein the plasma display apparatus provides a signal to the scan electrode and the signal includes:

an initialing pulse provided to said scan electrode during an initialization period, a scanning pulse provided to said scan electrode during an address period, a prescribed pulse provided to said scan electrode between said initialing pulse and said scanning pulse, the prescribed pulse having a peak voltage value less than a peak voltage value of the initialing pulse and greater than a ground voltage value, wherein the signal includes another prescribed pulse provided to the scan electrode between the initialing pulse and the prescribed pulse, and wherein a peak voltage value of the another prescribed pulse is different than the peak voltage value of the prescribed pulse.

16. The plasma display apparatus as claimed in claim 15, wherein the peak voltage value of the another prescribed pulse is less than the peak voltage value of the prescribed pulse.

17. A plasma display apparatus comprising:

a scan electrode and a plurality of common sustain electrodes formed on a first substrate;

an address electrode formed on a second substrate;

a plurality of barrier ribs provided between the first substrate and the second substrate;

a cell defined by the scan, sustain and address electrodes, and the plurality of barrier ribs, wherein the plasma display apparatus is configured to provide a signal to the scan electrode, and the signal includes:

an initialing pulse provided to said scan electrode during an initialization period, a scanning pulse provided to said scan electrode during an address period, a first sustaining pulse provided to said scan electrode during a sustain period, a second sustaining pulse provided to said common sustain electrodes during the sustain period; and a prescribed pulse provided between said initialing pulse and said scanning pulse and rising from a first voltage level to a second voltage level, the first voltage level being substantially equal to a voltage applied to the scan electrode just before said initialing pulse and the second voltage level being substantially equal to a voltage level applied to said first sustaining pulse, wherein the signal includes another prescribed pulse provided to the scan electrode between the initialing pulse and the prescribed pulse, and wherein a peak voltage value of the another prescribed pulse is different than the second voltage level of the prescribed pulse.

18. The plasma display apparatus as claimed in claim 17, wherein the peak voltage value of the another prescribed pulse is less than the second voltage level.

19. A plasma display apparatus comprising:

a scan electrode and a sustain electrode formed on a first substrate;

an address electrode formed on a second substrate;

a plurality of barrier ribs provided between the first substrate and the second substrate;

a cell defined by the scan, sustain and address electrodes, and the plurality of barrier ribs, wherein the plasma display apparatus is configured to provide a signal to the scan electrode and the signal includes:

an initialing pulse provided to said scan electrode during an initialization period, a scanning pulse provided to said scan electrode during an address period, and a first prescribed pulse provided between said initialing pulse and said scanning pulse, the first prescribed pulse having a positive peak voltage value, wherein the signal further includes a second prescribed pulse provided to the scan electrode between the initialing pulse and the first prescribed pulse, and wherein a peak voltage value of the second prescribed pulse is different than the positive peak voltage value of the first prescribed pulse.

20. The plasma display apparatus as claimed in claim 19, wherein the peak voltage value of the second prescribed pulse is less than the positive peak voltage value of the first prescribed pulse.

21. A method of driving a plasma display panel comprising:

providing a first signal to a scan electrode;

providing a second signal to a common sustain electrode; and providing a third signal to an address electrode, wherein the first signal is provided based on an initialization period, an address period, and a sustain period, wherein a prescribed period is provided between the initialization period and the address period, and a prescribed pulse is provided to the scan electrode during the prescribed period of time, the prescribed pulse having a positive peak voltage value, wherein another prescribed pulse is provided to the scan electrode during the prescribed period of time, and wherein a peak voltage value of the another prescribed pulse is different than the positive peak voltage value of the prescribed pulse.

22. The method of claim 21, wherein providing the second signal includes providing a separate sustain pulse to each of the common sustain electrodes during the sustain period.

23. The method of claim 21, wherein providing the third signal comprises providing data pulses to the address electrode during the address period.

24. The method of claim 21, wherein the peak voltage value of the another prescribed pulse is less than the positive peak voltage value of the prescribed pulse.

* * * * *